US008307883B2

(12) United States Patent
Jang et al.

(10) Patent No.: US 8,307,883 B2
(45) Date of Patent: Nov. 13, 2012

(54) MOLD POWDER SUPPLY APPARATUS USING THE WASTE HEAT OF A TUNDISH

(75) Inventors: Jinsoo Jang, Goyang-si (KR); Jutae Choi, Seoul (KR); Sukhyun Yoo, Chungcheongnam (KR)

(73) Assignee: Hyundai Steel Company, Incheon (KR)

( * ) Notice: Subject to any disclaimer, the term of this patent is extended or adjusted under 35 U.S.C. 154(b) by 2 days.

(21) Appl. No.: 12/955,849

(22) Filed: Nov. 29, 2010

(65) Prior Publication Data

US 2011/0079379 A1 Apr. 7, 2011

Related U.S. Application Data

(63) Continuation of application No. PCT/KR2009/004161, filed on Jul. 27, 2009.

(30) Foreign Application Priority Data

Aug. 28, 2008 (KR) ..... 10-2008-0084669

(51) Int. Cl.
*B22D 11/07* (2006.01)
*B22D 11/10* (2006.01)

(52) U.S. Cl. ..... 164/268; 164/472; 164/473

(58) Field of Classification Search ..... 164/472, 164/473, 268
See application file for complete search history.

(56) References Cited

U.S. PATENT DOCUMENTS

| | | | | |
|---|---|---|---|---|
| 2,688,478 | A * | 9/1954 | Lykken | 266/155 |
| 4,116,367 | A * | 9/1978 | Kataoka et al. | 222/144.5 |
| 4,821,791 | A * | 4/1989 | Aichert et al. | 164/506 |

FOREIGN PATENT DOCUMENTS

| | | | |
|---|---|---|---|
| CN | 2312086 | Y | 3/1999 |
| DE | 28 14 496 | A1 | 10/1979 |
| EP | 1 048 376 | A1 | 11/2000 |
| JP | 57-195568 | A | 12/1982 |
| JP | 62-169748 | U | 10/1987 |
| JP | 01-057961 | A | 3/1989 |
| JP | 05-200510 | A | 8/1993 |
| JP | 05-200512 | A | 8/1993 |
| JP | 11-005147 | * | 1/1999 |
| JP | 2007-181845 | A | 7/2007 |

OTHER PUBLICATIONS

International Search Report and Written Opinion dated Mar. 10, 2010 of corresponding PCT Application No. PCT/KR2009/004161 filed Jul. 27, 2009—6 pages.

European Search Report dated May 9, 2011 of corresponding European Patent Application No. 09810134.8—6 Pages.

Chinese Office Action dated Jul. 13, 2012 of corresponding Chinese Patent Application No. 200980119138.0 with English translation in 15 pages.

* cited by examiner

*Primary Examiner* — Kuang Lin

(74) *Attorney, Agent, or Firm* — Knobbe Martens Olson & Bear LLP

(57) ABSTRACT

The present invention relates to a mold powder supply apparatus using the waste heat of a tundish, which can collect waste heat from molten steel in the tundish, and preheat and dry mold powder. The mold powder supply apparatus using the waste heat of a tundish according to an embodiment of the present invention includes: a powder hopper that is mounted to a frame close to a tundish to absorb heat radiated from the top of the tundish, through one side; an agitator that agitates mold powder filled in the powder hopper; and a supply pipe that is connected to the bottom of the powder hopper to supply the powder hopper into a mold.

9 Claims, 5 Drawing Sheets

MOLD POWDER SUPPLY APPARATUS USING THE WASTE HEAT OF A TUNDISH

TECHNICAL FIELD

The present invention relates to a mold powder supply apparatus using the waste heat of a tundish, and more particularly, to a mold powder supply apparatus using the waste heat of a tundish having an improved structure that can collect waste heat from the tundish to preheat or dry the mold powder and increase usability of a space around the tundish.

BACKGROUND ART

In general, continuous casting equipment is to manufacture a semifinished product, such as a slab, from molten steel and largely includes a tundish, a mold, and a plurality of continuous casting rolls. The manufacturing process includes forming a solidified layer while molten steel passes through the mold, and then cooling the surface of the slab by injecting cooling water to the molten steel when the slab passing through the casting rolls arranged at both sides.

It is very important to control the surface temperature of a slab when manufacturing the slab in the continuous casting of the related art.

The slab undergoes bending and straightening during being casted in the continuous casting device, in which large stress is exerted in the surface of the slab.

Further, steel has a temperature range in which the toughness rapidly is reduced while being solidified and cooled from the molten steel. That is, defects are generated on the surface of the slab when the surface of the slab in the section where large stress is exerted has a temperature where the toughness rapidly reduces.

When the surface defects are generated in the slab, the productivity of the continuous casting decreases and, if excessive, the slab cannot be used.

The continuous casting has a process of putting mold powder into the mold. The mold powder not only allows the molten steel to be smoothly discharged out of the mold and insulate the surface of the molten steel. In addition, the mold powder prevents the molten steel from reoxidation, absorbs foreign substances, and improves heat transfer performance.

There are two types of methods of putting-in mold powder, wherein one is a manual putting-in type, in which a worker directly puts in mold powder with hands, and the other is an automatic putting-in type, in which mold powder is put in by a putting-in device.

However, in the manual putting-in type, the worker has to put in the mold powder under very poor work conditions due to a lot of dusts generated in putting in the mold powder and high-temperature heat radiated from the mold tundish, and a safety accident is likely to occur.

Further, since the mold powder are particles or little grains and easily absorb moisture from the atmosphere, specific heat source and device for preheating and drying the mold powder and the continuously supplied heat are needed. Thus, energy is wasted, and space for the equipment is needed in a limited space.

DISCLOSURE

Technical Problem

In order to solve the above problems, the present invention has been made in an effort to provide a mold powder supply apparatus using the waste heat of a tundish, which can preheat and dry mold powder, using waste heat generated from the tundish.

Technical Solution

In order to accomplish the above object, an embodiment of the present invention provides a mold powder supply apparatus using the waste heat of a tundish that includes a powder hopper that is spaced apart from a side of a tundish and disposed such that one side is heated by radiation heat transmitted from the top of the tundish, and has a space that is filled with mold powder.

The powder hopper further includes an agitating unit that agitates the mold powder therein, and the agitating unit includes an impeller motor that is disposed at the top of the powder hopper and rotates an agitating impeller disposed in the powder hopper using power supplied from the outside.

The powder hopper becomes narrow as going down from the top to the bottom thereof.

One side of the powder hopper which is close to the tundish is rounded in an arch shape.

The agitating impeller is provided with a heat medium pipe therein that receives and transmits waste heat from the tundish.

The powder hopper further includes a secondary heat transfer unit that collects the waste heat generated outside the tundish and transmits the heat to the powder hopper, and the secondary heat transfer unit includes a heat supply pipe attached on the outer side of the tundish and containing a heat transfer medium and a heat transfer pipe communicating with the heat supply pipe in contact with the outer side of the powder hopper.

Advantageous Effects

According to the embodiments of the present invention, it can preheat and dry mold powder by using waste heat from molten steel in a tundish. In addition, it is possible to save energy by using the waste heat from the tundish to dry the mold powder and improve spatial usability installing for the powder hopper.

BEST MODE

Hereinafter, embodiments of the present invention will be described in detail with reference to the accompanying drawings.

Figure 1:
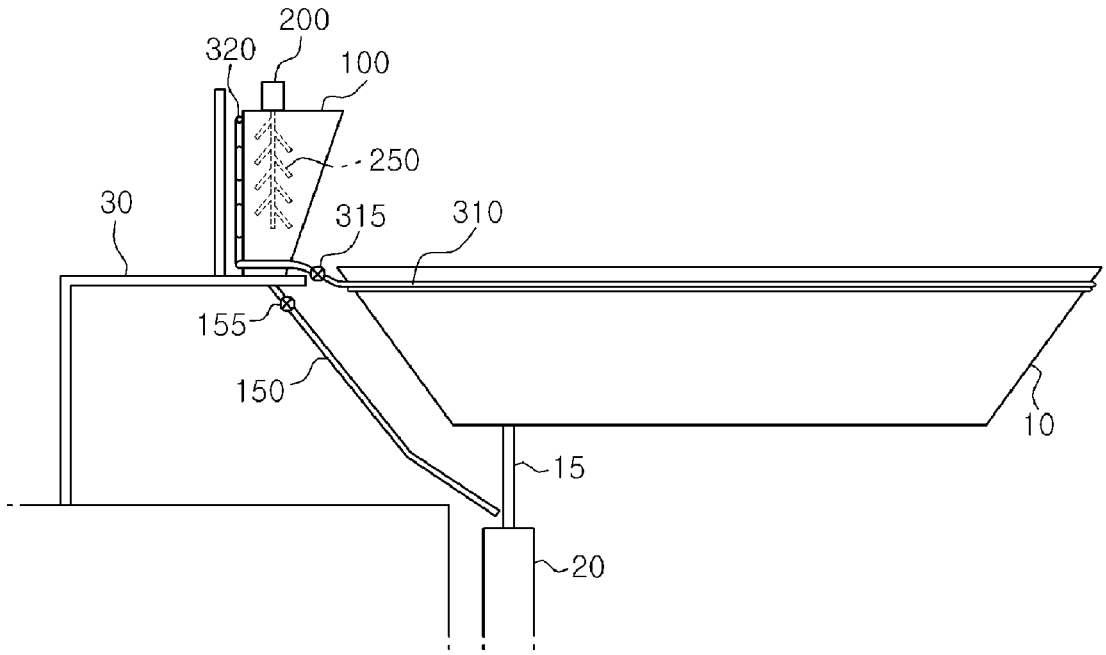
FIG. 1 is a view schematically showing the configuration of a first embodiment of an apparatus for mold powder using waste heat from a tundish according to the present invention.
Figure 2:
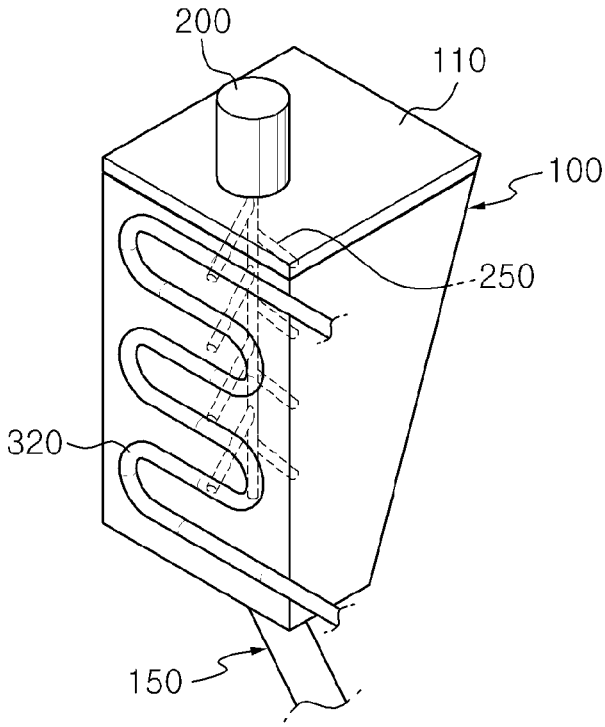
FIG. 2 is a perspective view showing a powder hopper of the present invention.
Figure 3:
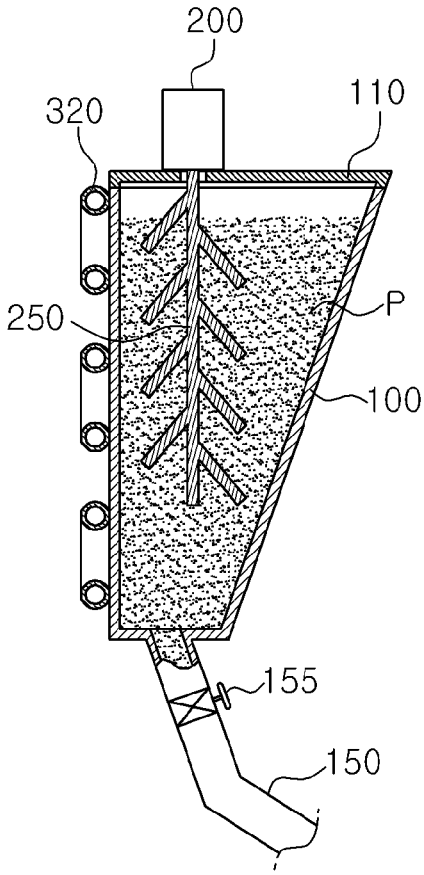
FIG. 3 is a cross-sectional view of FIG. 2.

Referring to FIGS. 1 to 3, a mold powder supply apparatus using the waste heat of a tundish according to a first embodiment of the present invention includes: a powder hopper 100 that is mounted to a frame 30 close to a tundish 10 to absorb heat radiated from the top of the tundish 10 through one side thereof; an agitator that agitates mold powder P filled in the powder hopper 100; and a supply pipe 150 that is connected to the bottom of the powder hopper 100 to supply the mold powder P from the powder hopper 100 into a mold.

In more detail, the powder hopper 100 has a structure that narrows from the top down, with one side inclined to be close to the top of the tundish 10.

The supply pipe 150 is a pipe through which the mold powder P can be carried and equipped with a supply valve 155 at the middle portion to selectively supply the mold powder P that is carried.

The agitator includes an agitating impeller 250 having a plurality of blades on the outer circumference and disposed in the powder hopper 100, and an impeller motor 200 disposed at the top of the powder hopper 100 and operated by power supplied from the outside to rotate the agitating impeller 250.

Further, the powder hopper 100 is provided with a cover to prevent internal heat from transferring to the outside and supporting the impeller motor 200 at the top.

The powder hopper 100 is preferably made of steel in consideration of heat conductivity and strength, but is not limited thereto.

Further, it is preferable to further include a secondary heat transfer unit that collects waste heat generated from the tundish 10 and transfer it to the powder hopper 100.

The secondary heat transfer unit is composed of a heat supply pipe 310 attached to the outer side of the tundish 10 and filled with a heat transfer medium, and a heat transfer pipe 320 communicating with the heat supply pipe 310 and disposed in contact with the opposite side of the powder hopper 100.

The heat supply pipe 310 is wound around a portion of or the entire outer side of the tundish 10 such that the waste heat is supplied from the tundish 10 to the heat transfer pipe 320 by the heat transfer medium.

It is preferable that the heat transfer pipe 320 is bent several times in an S-shape to transfer heat uniformly to the opposite side of the powder hopper 110, but may be composed of a plurality of separate pipes, which are disposed at different height on the opposite side.

It is preferable to use, as the heat transfer medium, a medium having a boiling point within 200 to 500° C. or grease having a high melting point to be able to transfer high-temperature heat from the tundish 10.

In this configuration, a pump (not shown) is provided to send the heat transfer medium and a valve 315 is disposed at a predetermined portion in the heat supply pipe 310 to control sending the heat transfer medium.

Not stated above, reference numeral '15' indicates an immersion nozzle guiding molten steel from the tundish and reference numeral '20' indicates a mold that manufactures a slab by solidifying the molten steel guided by the immersion nozzle.

The operation of the present invention having this configuration is described hereafter.

The mold powder supply apparatus using the waste heat of a tundish includes the powder hopper 100 on the frame 30 close to the tundish 10. The high-temperature radiation heat is transmitted upward from the molten steel in the tundish 10, and one side of the powder hopper 100 is heated. Thus, the mold powder P in the powder hopper 100 is preheated and dried.

In this process, the heat supply pipe 310 on the outer side of the tundish 10 absorbs waste heat transmitted through the outer side of the tundish 10, and transmits the heat to the heat transfer pipe 320 using the grease which is a heat transfer medium. Thus, the opposite side of the powder hopper 100 is heated, and the mold powder P is preheated and dried.

The grease which is a heat transfer medium is sent from the heat supply pipe 310 to the heat transfer pipe 320 by pressure from the pump, after the worker opens the valve 315.

Thereafter, the impeller motor 200 included in an agitating unit is operated to uniformly heat and dry the mold powder P in the powder hopper 100, and the agitating impeller 250 located under the impeller motor 200 is rotated and agitates the mold powder P.

Accordingly, radiation heat is transmitted from the top of the tundish 10 to one side of the powder hopper 100 which is close to the top of the tundish 10 and the waste heat collected by the heat transfer medium in the heat transfer pipe 320 is transmitted to the opposite side. Thus, the mold powder P in the powder hopper 100 is preheated and dried.

The mold powder P preheated and dried is supplied into the mold through the supply pipe 150 connected to the bottom of the powder hopper to function as the powder itself.

In this process, the supply pipe 150 is selectively opened by operating the supply valve 155 in the pipe line. Thus, the mold powder P can be sent from the powder hopper 100 above the mold, when the supply valve 155 is open.

Figure 4:
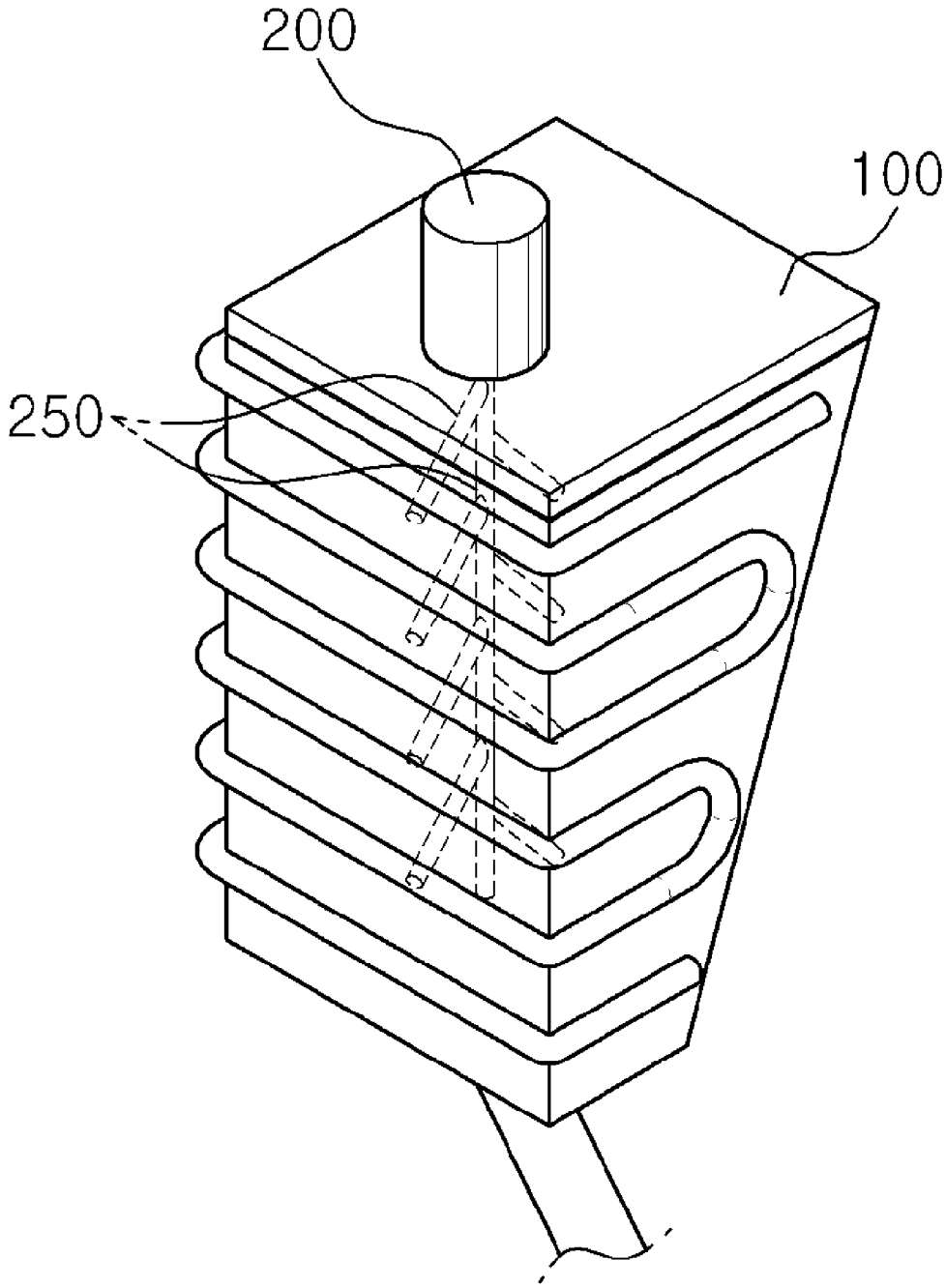
FIG. 4 is a view schematically showing the configuration of a second embodiment of an apparatus for mold powder using waste heat from a tundish according to the present invention.

FIG. 4 shows a second embodiment of a mold powder supply apparatus using the waste heat of a tundish according to the present invention, in which the heat transfer pipe 320 may be disposed not only on the opposite side of the powder hopper 100, but on the other sides.

Further, though not shown in the figure, the heat transfer pipe 320 may be wound around the powder hopper 100.

That is, it is possible to adopt a structure having the heat transfer pipe 320 wound around the powder hopper 100.

Figure 5:
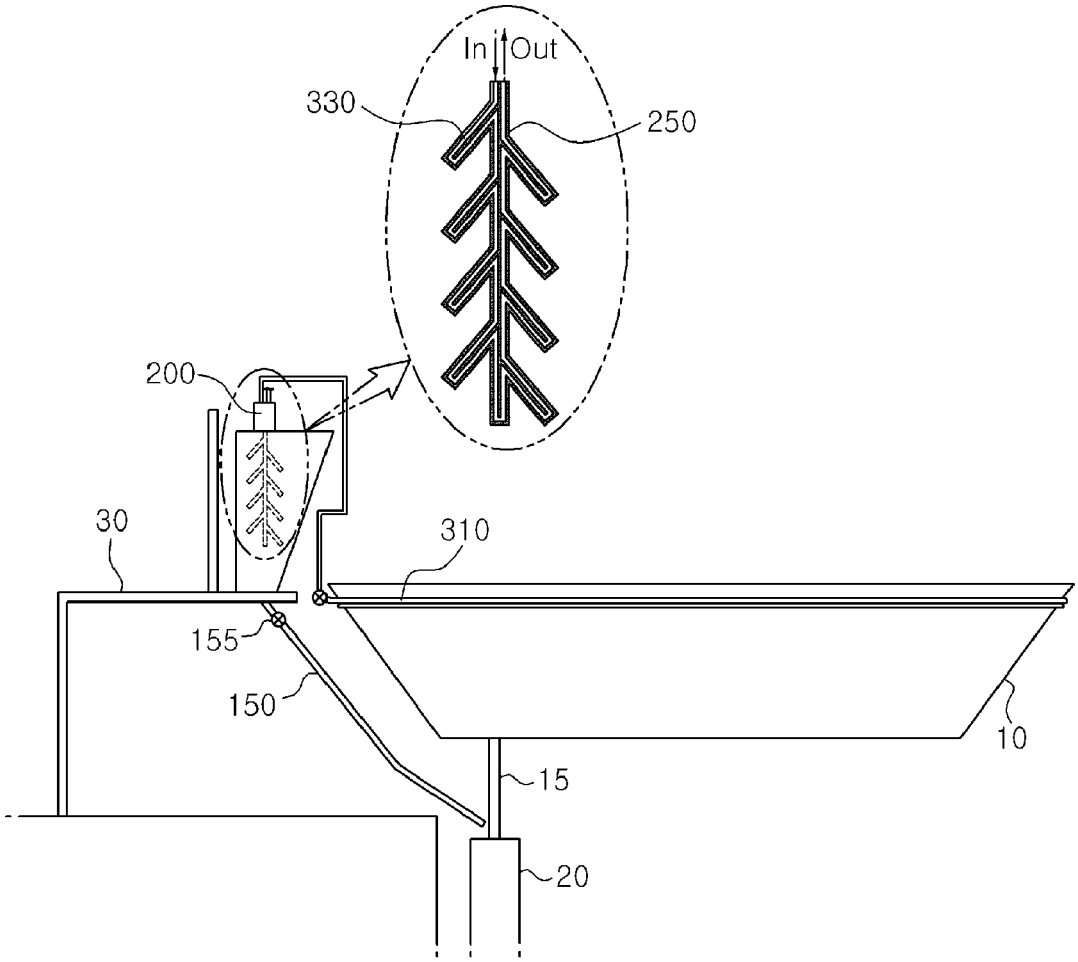
FIG. 5 is a view schematically showing the configuration of a third embodiment of an apparatus for mold powder using waste heat from a tundish according to the present invention.

FIG. 5 shows a third embodiment of a mold powder supply apparatus using the waste heat of a tundish according to the present invention. The apparatus includes heat medium pipes 330 disposed in the agitating impeller 250 and connected with the heat transfer pipe 310 collecting and transferring the waste heat from the tundish 10.

The heat medium pipes 300 are arranged in a zigzag in the agitating impeller 250 to correspond to the external shape of the agitating impeller 250.

Figure 6:
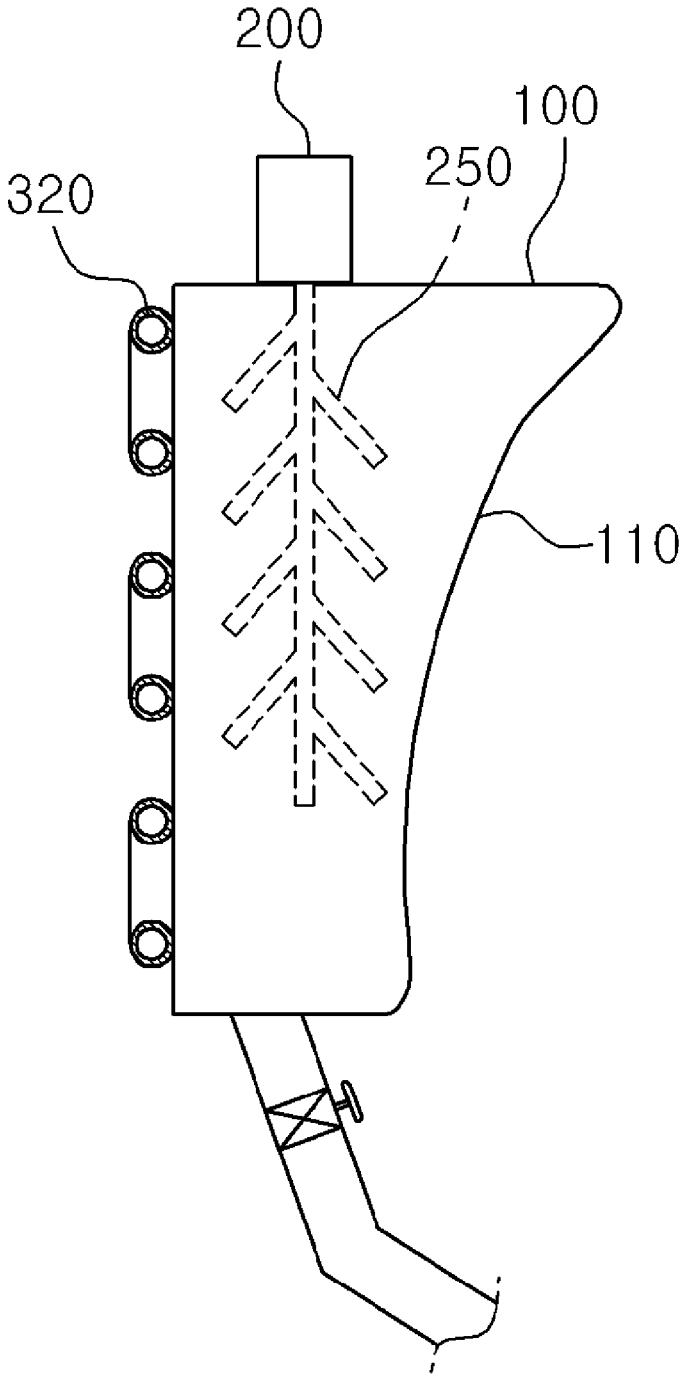
FIG. 6 is a view schematically showing the configuration of a fourth embodiment of an apparatus for mold powder using waste heat from a tundish according to the present invention.

FIG. 6 shows a fourth embodiment of a mold powder supply apparatus using the waste heat of a tundish according to the present invention. One side of the powder hopper 100 which is close to the tundish 10 is rounded in an arc shape having a predetermined curvature.

This shows that the outer side of the powder hopper 100 can be implemented in another shape to easily collect the waste heat from the tundish 10.

As described above, the present invention designed to preheat and dry mold powder by collecting radiation heat and waste heat from molten steel in the tundish 10 is not limited to the embodiments and may be modified in various ways without departing from the scope of the present invention, and it should be noted that the modifications are included in the present invention.

What is claimed is:

1. A casting apparatus comprising:

a tundish configured to contain molten steel and to supply the molten steel to a mold, the tundish comprising a top from which the molten steel radiate heat; and a powder hopper configured to contain mold powder and to supply the mold powder to the mold, the powder hopper comprising at least one side wall facing the tundish, wherein the at least one side wall comprises a side surface positioned at a level higher than the top of the tundish and inclined to face down to the top of the tundish for receiving direct heat radiation from the molten steel contained in the tundish.

2. The casting apparatus according to claim 1, wherein the powder hopper further includes an agitator configured to agitate the mold powder contained therein, and wherein the agitator includes an impeller motor disposed at the top of the powder hopper and configured to rotate an agitating impeller.

3. The casting apparatus according to claim 1, wherein the powder hopper becomes narrow as going down from the top to the bottom thereof.

4. The casting apparatus according to claim 1, wherein the side surface of the powder hopper is rounded in an arch shape.

5. The casting apparatus according to claim 2, wherein the agitating impeller is provided in the power hopper with a fluid conduit configured to circulate fluid therein.

6. The casting apparatus according to claim 5, wherein the fluid conduit is in fluid communication with a heat exchanger configured to receive heat from the tundish.

7. The casting apparatus according to claim 1, further comprising:

a heat exchanger comprising a fluid circulation conduit and a fluid circulating through the fluid circulation conduit, wherein the fluid circulation conduit extends between the tundish and the powder hopper such that the fluid takes heat from the tundish and releases the heat to the powder hopper.

8. The casting apparatus according to claim 1, wherein the side surface is substantially flat.

9. The casting apparatus according to claim 1, wherein substantially all surface areas of the at least one side wall facing the tundish are positioned at a level higher than the top of the tundish and included to face down to the top of the tundish.

* * * * *